US008171659B2

(12) United States Patent
Hursen

(10) Patent No.: US 8,171,659 B2
(45) Date of Patent: May 8, 2012

(54) METHOD AND APPARATUS FOR SELECTIVE SOIL FRACTURING, SOIL EXCAVATION OR SOIL TREATMENT USING SUPERSONIC PNEUMATIC NOZZLE WITH INTEGRAL FLUIDIZED MATERIAL INJECTOR

(76) Inventor: Thomas Francis Hursen, Allison Park, PA (US)

( * ) Notice: Subject to any disclaimer, the term of this patent is extended or adjusted under 35 U.S.C. 154(b) by 711 days.

(21) Appl. No.: 12/332,337

(22) Filed: Dec. 10, 2008

(65) Prior Publication Data

US 2009/0145665 A1 Jun. 11, 2009

Related U.S. Application Data

(60) Provisional application No. 61/005,900, filed on Dec. 10, 2007.

(51) Int. Cl.
*E02F 3/88* (2006.01)

(52) U.S. Cl. ..... 37/323; 37/195

(58) Field of Classification Search ..... 37/317, 37/318, 322, 323, 347, 335, 342, 195; 175/66, 175/67, 424, 324, 213; 406/88, 96, 153, 406/162, 157

See application file for complete search history.

(56) References Cited

U.S. PATENT DOCUMENTS

| | | | | |
|---|---|---|---|---|
| 3,599,876 | A | 8/1971 | Kyburg | |
| 3,647,142 | A | 3/1972 | Drude et al. | |
| 3,672,575 | A | 6/1972 | Hinrichs | |
| 3,743,186 | A | 7/1973 | Mocarski | |
| 3,774,847 | A | 11/1973 | Malec | |
| 3,790,084 | A | 2/1974 | Kinsley | |
| 3,790,085 | A | 2/1974 | Ayer | |
| 3,814,329 | A | 6/1974 | Clark | |
| 3,888,422 | A | 6/1975 | Robinson | |
| 3,963,180 | A | 6/1976 | Wagner | |
| 4,025,045 | A | 5/1977 | Kubiak | |
| 4,026,474 | A | 5/1977 | Knauer et al. | |
| 4,036,438 | A | 7/1977 | Soderlind et al. | |
| 4,038,786 | A | 8/1977 | Fong | |
| 4,243,178 | A | 1/1981 | Self | |
| 4,677,958 | A | 7/1987 | Gayler | |
| 4,721,249 | A | 1/1988 | Lassiter | |
| 4,813,611 | A | 3/1989 | Fontana | |
| 4,905,481 | A | 3/1990 | Scaringe | |
| 5,119,744 | A | 6/1992 | Comer | |
| 5,135,167 | A | 8/1992 | Ringer | |
| 5,167,878 | A | 12/1992 | Arbisi et al. | |
| 5,170,943 | A | 12/1992 | Artzberger | |
| 5,212,891 | A | 5/1993 | Schuermann et al. | |
| 5,285,965 | A | 2/1994 | McCutcheon et al. | |
| 5,531,590 | A | 7/1996 | Browning | |
| 5,558,463 | A | 9/1996 | Geisel | |
| 5,681,132 | A | 10/1997 | Sheppard, Jr. | |
| 5,713,212 | A | 2/1998 | Barnett et al. | |
| 5,782,414 | A | 7/1998 | Nathenson | |
| 5,901,478 | A * | 5/1999 | Sawyer, Jr. | 37/323 |
| 6,470,605 | B1 * | 10/2002 | Gilman et al. | 37/323 |

(Continued)

*Primary Examiner* — Robert Pezzuto
(74) *Attorney, Agent, or Firm* — Blynn L. Shideler; Krisanne Shideler; BLK Law Group

(57) ABSTRACT

An apparatus and associated method of soil working is provided for performing one or more of soil fracture, soil excavation and soil treatment. The method comprises the steps of: supplying a source of pressurized gas; supplying a source of fluidized material; positioning a nozzle adjacent the soil; directing a stream of the pressurized gas through the nozzle at the soil being worked; and entraining a stream of fluidized material in the gas stream prior to the stream reaching the soil.

20 Claims, 5 Drawing Sheets

U.S. PATENT DOCUMENTS 6,618,966 B2 * 9/2003 Russo et al. ..... 37/335
6,811,812 B2 11/2004 Van Steenkiste
6,834,720 B1 * 12/2004 Dwyer et al. ..... 166/289
6,868,830 B1 3/2005 Meyer et al.
6,983,587 B2 1/2006 Shumate
7,484,322 B2 * 2/2009 Maybury et al. ..... 37/323
7,743,537 B2 * 6/2010 Maybury, Jr. ..... 37/323

* cited by examiner 24
24A
25
28
26
27
18
18A
19
21
22
23
8
12
13
14
29

11
17
16
3

14
4
5
6
1
13
10
9
2
12
15
7

24
24A
25
28
27
22
23
18
18A
19
13
14
35
8
2
1

34 (L)
30
32
31
33

41
39
38
37
36
40

24
24A
25
28
27
18
18A
19
14
22
23
12
8
13
41
39
38
37
36
40
35
2
11
1

11
1
5
7

METHOD AND APPARATUS FOR SELECTIVE SOIL FRACTURING, SOIL EXCAVATION OR SOIL TREATMENT USING SUPERSONIC PNEUMATIC NOZZLE WITH INTEGRAL FLUIDIZED MATERIAL INJECTOR

RELATED APPLICATIONS

The present application claims the benefit of provisional patent application Ser. No. 61/005,900 filed Dec. 10, 2007 entitled "Supersonic Air Knife and Fluid Injector Combination".

BACKGROUND OF THE INVENTION

1. Field of the Invention

The present invention relates to soil fracture, soil excavation and soil treatment using supersonic nozzles, in particular to a method and apparatus for soil excavation and treatment using supersonic pneumatic nozzle with integral fluidized material injector for incorporating liquids or fluidized pellets into the air stream.

2. Background Information

Tools for digging safely in the earth to either uncover buried objects or to dig safely near them using compressed air as an energy source and as a digging medium have been used in recent years. U.S. Pat. No. 5,782,414, which is incorporated herein by reference, exemplifies that it has been well known that compressed air released in close proximity to and directed toward the ground can result in loosening of a number of types of soil. A number of tools have been marketed produce an air stream for improved digging purposes by making the air exit the tool at a supersonic speed. For example, U.S. Pat. No. 4,813,611, which is incorporated herein by reference, discloses a compressed air nozzle for use in soil excavation to uncover buried pipes, electrical cables and the like. U.S. Pat. No. 5,170,943 discloses a similar tool with a handle, valve, electrically insulating barrel, and a nozzle. The '943 patent includes a conical shield to protect the operator, but nothing to protect the nozzle. U.S. Pat. No. 5,212,891 discloses a further excavating pneumatic nozzle design.

A wand or tool, consisting of a valve, length of pipe or tubing, and ending in a reduced sized nipple or nozzle, supplied with air from a standard portable compressor, is commonly used for the purposes of dislodging soil safely from around underground utilities such as gas, water, or sewer pipes and electric, telephone, television, or other cables. The compressed air does not pose a hazard of damaging the buried utility as does a pick, digging bar, spade, bucket, or blade.

The ability to unearth safely other types of buried objects is also important. For example, in the industrial or nuclear energy sectors, such objects include glass bottles, cardboard or wood boxes, metal or fiber drums, or metal cylinders of chemical or radioactive waste. From the military sector, objects include all types of unexploded ordnance or chemical munitions.

These tools have also been used to disturb and fracture soil structure for the purpose of reducing compaction (de-compaction) and other arboriculture purposes. One purpose of this fracturing is to facilitate the propagation and growth of plant roots, which otherwise can not grow into significantly compacted soil. This difficulty for plants is further aggravated, when compacted soil has a low moisture content. Another purpose of this fracturing, which tends to occur laterally from a vertical hole opened by a supersonic nozzle's jet stream, as an example, has been used to insert soil remediation materials beneficial to plants, either liquid or solids. This procedure has also been used, for other various purposes, including the amelioration of the hazardous properties of soil contaminants.

As a matter of clarification, air excavation nozzles should not be confused with the rocket nozzles. Supersonic air excavation nozzles used for excavation purposes are different than rocket nozzles in a number of important ways. Supersonic air nozzles for earth excavation operate at significantly lower pressures and temperatures than rocket nozzles. For example, a rocket's chamber pressure may reach 1,000 to 3,000 psig and the exhaust gas temperature may be 1,800° to 7,700° F., while typical gas jet excavation nozzles operate at around 100 to 200 psig and at 80° to 140° F. The velocity of the exhaust gas exiting from a chemical rocket's nozzle may be from 6,000 to 14,000 ft/sec; while for an excavation nozzle typical values are from 1,700 to 2,000 ft/sec. The specific nozzle profile for a typical rocket nozzle is, thus, significantly different in shape than for an air excavation nozzle.

U.S. Pat. No. 6,845,587 describes the practices of revival woody plants that are in decline, which revival of the plant is usually preferred to replanting. Revival avoids costs for removal and additional costs for replacement. Typically, revival has meant either aggressively fertilizing the subject plant and/or loosening the soil. Revival success is dependent on the degree of soil compaction and existing moisture content. Earlier methods include laboriously exposing roots using trowels and small digging implements. Once exposed, the roots were reburied with new loose soil or covered with the existing soil now more loosened. This early, labor intensive method is similar to the way archaeologists dig for shards of pottery—slow and tedious. An improvement over manual excavation is a vertical mulching technique where a grid of 1 to 2 inch holes is drilled in the rooting soil. The holes are then backfilled with porous material and/or fertilizer.

One technique of soil loosening uses compressed air. Compressed air released at supersonic speed fractures the soil, with minimal damage to roots. Unlike porous soil, non-porous matter, such as roots, remain minimally damaged by the compressed air. Soil fracturing avoids the problems of mechanical excavation.

Fracturing soil by using compressed air is popularly used on lawns and turfs, such as golf courses. To maximize efficiency compressed air is injected in a grid. The grid is spaced so to aerate the soil evenly throughout a specified area by fracturing the soil.

Specifically, U.S. Pat. No. 6,845,587 provides for the provision of a method of improving the rooting soil of a woody landscape plant comprising the steps of exposing a root collar of a plant; defining a first improvement zone encompassing the root plate area; excavating the first improvement zone with an air excavator; and adding a beneficial treatment to the first improvement zone.

In a related field, soil treatment is often required in many applications, such as for plant treatment or soil remediation applications. Tools for injecting liquids and solids (such as granular pellets) into the ground are in use and which utilize a wide variety of injection methods, including manually by hand, pumps, and mechanical augers. These systems are often unsatisfactory because of their inefficiencies (manual & inductors) and potential for mechanical damage to roots and buried utilities (e.g., augers).

One purpose of this invention is to provide an improved, efficient, integrated, safe, light weight, optimized and economical combination of supersonic air digging and high velocity liquid or fluidized material (e.g., pellets) induction directly into the supersonic air stream, for many purposes, including those enumerated above, using a single source of compressed air.

SUMMARY OF THE INVENTION

The above object is achieved with the embodiments according to this invention, which in one non-limiting embodiment of the present invention provides an apparatus for and associated method of soil working performing one or more of soil fracture, soil excavation and soil treatment. The method comprises the steps of: supplying a source of pressurized gas; supplying a source of fluidized material; positioning a nozzle adjacent the soil; directing a stream of the pressurized gas through the nozzle at the soil being worked; and entraining a stream of fluidized material in the gas stream prior to the stream reaching the soil.

In one aspect of the invention the gas directed at the soil and entraining the fluidized material is air. The stream of fluidized material may be comprised of solid particles, such as pellets of treatment (fertilizer, fungicide, insecticide, combinations thereof, and/or other soil treatments). The stream of fluidized material may be comprised of liquid material. The fluidized material can be combinations of solids and liquids.

The stream of fluidized material may be entrained in the stream of air at a position downstream of the throat of the nozzle prior to the impacting of the soil with the combined streams.

The method of soil working may further comprise the step of providing co-axial barrels for, respectively, conveying the air stream to the nozzle and the stream of fluidized material to the entrainment position. In one co-axial embodiment of the invention the barrel conveying the stream of fluidized material to the entrainment position is radial inwardly of the barrel conveying the stream of air to the nozzle. In one non-limiting embodiment of the invention, radial locating pins are provided to position the barrel conveying the stream of fluidized material to the entrainment position is radial inwardly of the barrel conveying the stream of air to the nozzle.

Other aspects of the present invention that can optionally be included is the provision of a user protecting shield around the outer barrel. Further the method may include controls selectively controlling the flow of the air stream and the stream of fluidized material, respectively. Further the method may include a pump for pressurizing the stream of fluidized material. Further the method may include the step of extending the respective length between the nozzle and the source of pressurized air.

A separate categorization of the features of the present invention, in a non-limiting manner, is that the present invention provides a method of working a material bed for performing one or more of fracture of the bed material, excavation of the bed material and treatment of the bed material, said method comprising the steps of: supplying a source of pressurized gas; supplying a source of fluidized material; providing hand held co-axial barrels, one barrel conveying the gas from the source of pressurized gas and the other barrel conveying fluidized material from the source of fluidized material; entraining a stream of fluidized material in the gas stream; and impacting the combined streams against the material bed being worked. The material bed, for example, may be soil and the gas directed at the soil and entraining the fluidized material may be, for example, air.

These and other advantages of the present invention will be clarified in the description of the preferred embodiments taken together with the attached drawings.

BRIEF DESCRIPTION OF THE DRAWINGS

Other objects and advantages appear in the following description and claims. The enclosed drawings illustrate some practical embodiments of the present invention, without intending to limit the scope of the invention or the included claims.

DESCRIPTION OF THE PREFERRED EMBODIMENTS

Figures 1, 2:
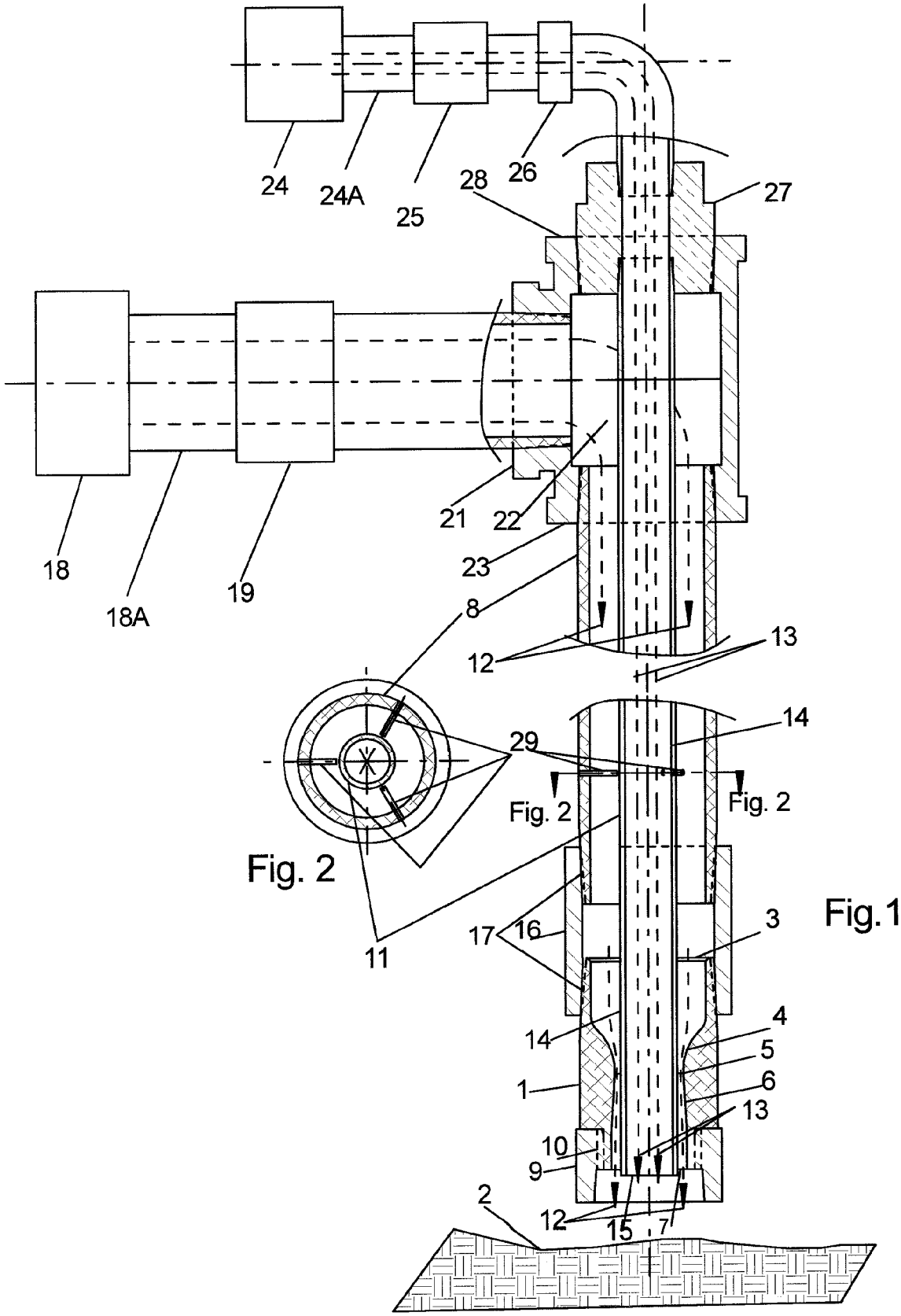
FIG. 1 is a side elevation view, partially is section, of a material bed working system according to one non-limiting embodiment of the present invention and for implementing the methods according to one aspect of the present invention.
FIG. 2 is a cross section view of the system of FIG. 1 taken along line 2-2.

FIG. 1 shows an embodiment that is preferred for it's simplicity of construction of the liquid supply entry, into the complete system and because the liquid entrainment and injection location is optimum. The system is in a generally vertical position, which is typical for it's use. The supersonic nozzle I is at the bottom, with it's output towards and close to the ground 2, generally soil but may be another material bed. The nozzle 1 is supersonic by virtue of its internal construction and desired operation. That means that gas, generally air, flowing going down to the nozzle 1 enters the nozzle entrance 3, then through a nozzle contraction 4, a nozzle throat 5, a nozzle expansion 6, then out the nozzle exit 7 at supersonic speed, depending upon the particulars of the design, as known in nozzle construction.

Gasses other than air can be used, such as nitrogen, but the remaining description will use air as that will be gas of choice in the vast majority of applications because of its accessibility and that most application will not require another carrier and working gas to be used. The air flow path 12, originates at an air compressor 18, passes through an air supply valve 19, at the discretion and control of an operator, and then enters a plenum 22 through an air supply port 21. From the plenum 22, the air travels through a barrel port 23, down a barrel 8 and into the nozzle entrance 3, the nozzle contraction 4, the nozzle throat 5, the nozzle expansion 6 and the nozzle exit 7.

Similarly, a fluidized material source 24 supplied fluidized material. The fluidized material may be a liquid or a solid containing stream (e.g. pellets). For the sake of this discussion the material will be referenced as a liquid. The liquid source 24, supplies liquid, through a liquid supply valve 25, at the operators discretion, and through a liquid pipe union 26, through a liquid conducting tube adaptor 27, and through liquid supply port 28 into a liquid conducting tube 14. In this embodiment, the liquid conducting tube 14, is coaxial and within the barrel 8. The liquid flow path 13, continues into the supersonic nozzle 1, exiting axially, at the tube exit 15, anywhere between the nozzle exit 7 and the protected interior of the protection tip 9. Also the protection tip 9, is connected to the supersonic nozzle 1, by a protection tip/nozzle thread 10.

Figures 5, 6, 7:
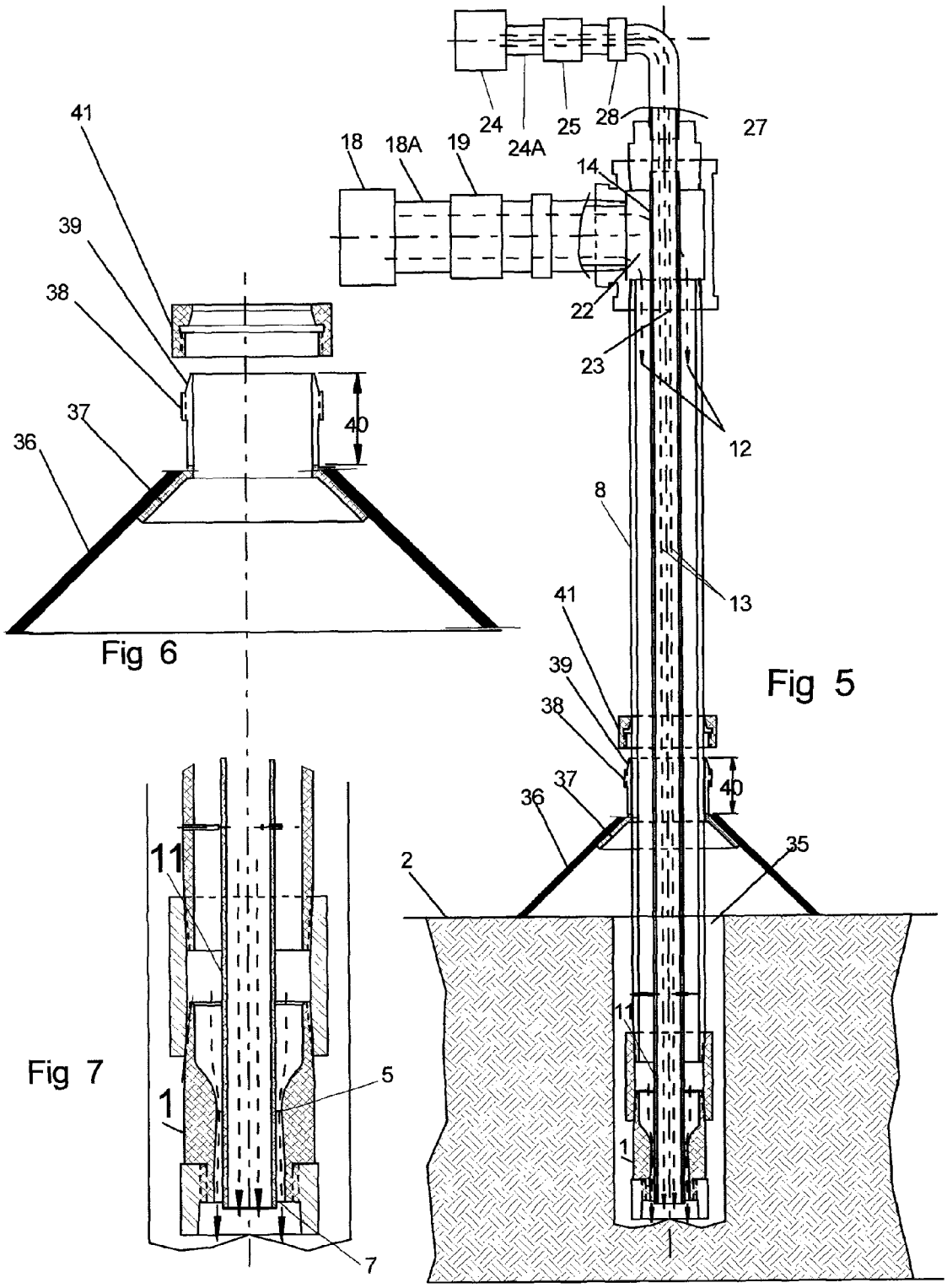
FIG. 5 is a side elevation section view of the system of FIG. 1 further including a user protecting shield.
FIG. 6 is a side elevation section view of the shield of FIG. 5.
FIG. 7 is a side elevation view of the nozzle end of the system of FIG. 5.

Thus the liquid flow path 13 is presented to the maximum air velocity of the nozzle air flow path 12, which is the most efficient position for fluid induction (or entrainment) since this velocity develops the maximum available local pressure reduction, according to Bernoulli's equation. FIG. 7 is an enlargement of the supersonic nozzle 1 and the surrounding structure, for increased clarity.

This configuration of entraining the fluid at this stage avoids serious disruption of the air flow until after the nozzle air flow path 12 has fully developed supersonic velocity. Also, the tube exit 15 being positioned in this manner, maximizes the efficiency of the system when the system is in the fluid injecting mode. This is because the liquid conducting tube 14 parallels the supersonic nozzle 1 axis until, at minimum, the liquid conducting tube 14 goes beyond the nozzle exit.

The calculation of the shape and area progression of the supersonic nozzle 1, begins in the usual manner, but since the supersonic nozzle 1, surrounds the liquid conducting tube 14, the calculation of the supersonic nozzle 1, requires diameter adjustments that account correctly for the presence of the liquid conduction tube 14. The nozzle connects to the barrel through a nozzle-barrel coupling. 16, by a nozzle-barrel coupling thread 17.

FIG. 2 illustrates the support of the liquid conducting tube by three, equally spaced locating pins 29, projecting through the wall of the barrel 8. The liquid conducting tube 14 is also positioned within the liquid conducting tube at its upper end in adaptor 27. Pins 29 are selected to provide a minimal obstruction to the air flow path 12, while supplying suitable radial stiffness for supporting and locating the inner barrel. These locating pins 29 could be within the barrel 8, within the coupling 16 or within the nozzle entrance 3.

Figures 3, 4:
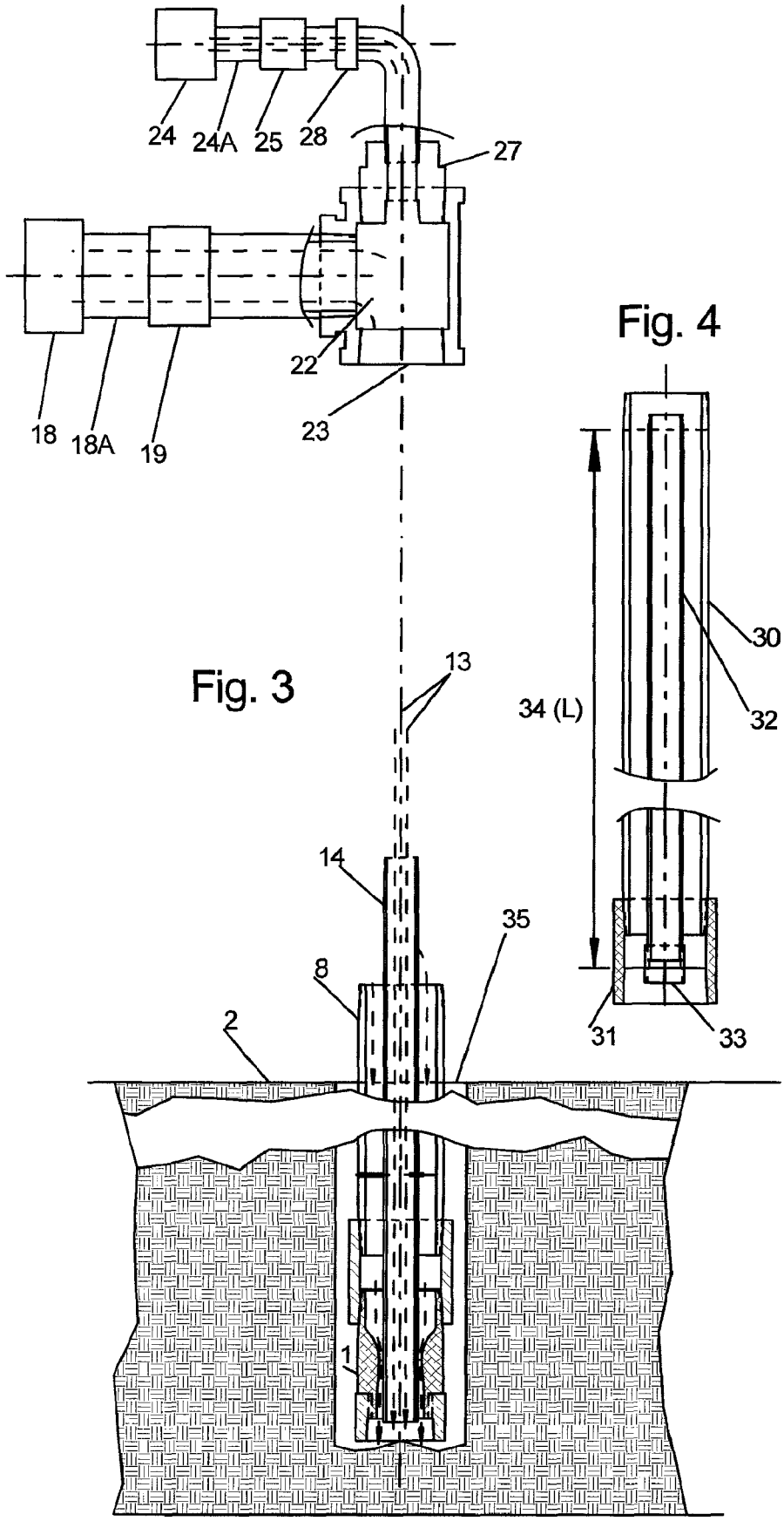
FIG. 3 is an exploded view of the system of FIG. 1.
FIG. 4 is a side elevation section view of an extending member for extending the system of FIG. 1 and shown in FIG. 3.

FIG. 3 is an elevation view of the same orientation of FIG. 1, illustrating the barrel 8 separated from the barrel port 23, and ready to accept a barrel extension 30 for extending the effective length of the system. FIG. 4 is a barrel extension 30, with a barrel extension coupling 31, with a tube extension 32 with its tube extension coupling 33, together, available to extend the barrel 8, and the liquid conducting tube 14, after a hole 35 has been dug and/or injected with a fluid by the configuration shown in FIG. 1.

A typical air digger barrel 8 may be 3.5 feet long. This is usually sufficient length to treat the depth of ground 2, namely soil, which contains most tree and bush roots. However, soil remediation and environmental applications and some arboriculture applications can require deeper treatments, up to twelve feet into the ground and possibly deeper. This requires one or multiple barrel extension(s) 30, etc. Since the liquid conducting tube 14, is positioned near it's bottom and the bottom of the barrel 8, by the locating pins 29, extensions are best inserted near the top of the barrel 8. This is done by decoupling the barrel 8, and the liquid conducting tube 14, at their respective upper ends in an appropriate sequence (e.g., barrel 8 first, then the liquid conducting tube 14). Then insert the desired length barrel extension 30, and barrel extension coupling 31, with the tube extension 32 and its tube extension coupling 33, together, which is illustrated in FIG. 4. The user will tighten the tube extension 32, with its tube extension coupling 33, first at their lower end, then at their upper end. A convenient net extension length increase 34(L), is 3.5 feet, which is also a convenient length for the original barrel 8. This facilitates extensions being coupled at a convenient distance above the surface of the ground 2, for a person of average height.

FIG. 5 shows repeats FIG. 1, but illustrates the supersonic nozzle inserted within the ground, in a digging position, with the addition of a flexible shield 36, to protect the operator and the local environment from dirt or liquid blow back, locally at the entrance to the hole 35 in the ground 2. FIG. 6 is an enlargement of the flexible shield 36. It is flexible so as to better seal against uneven ground. It illustrates the shield insert 37, which may be glued, bolted or vulcanized to the flexible shield. The upper portion of the shield insert 37 is an integral collet, with threads 38, axial slots of length 40, and a collet taper 39. Also shown is a collet lock nut 41, whose interior acts against the taper 39 to squeeze the collet against the exterior of the barrel 8 to locate the flexible shield 36 in any axial barrel location. It may also be backed off so that the flexible shield is free to stay in position against the ground when the barrel is moving into and out of the hole 35 when the tool is digging.

Figure 8:
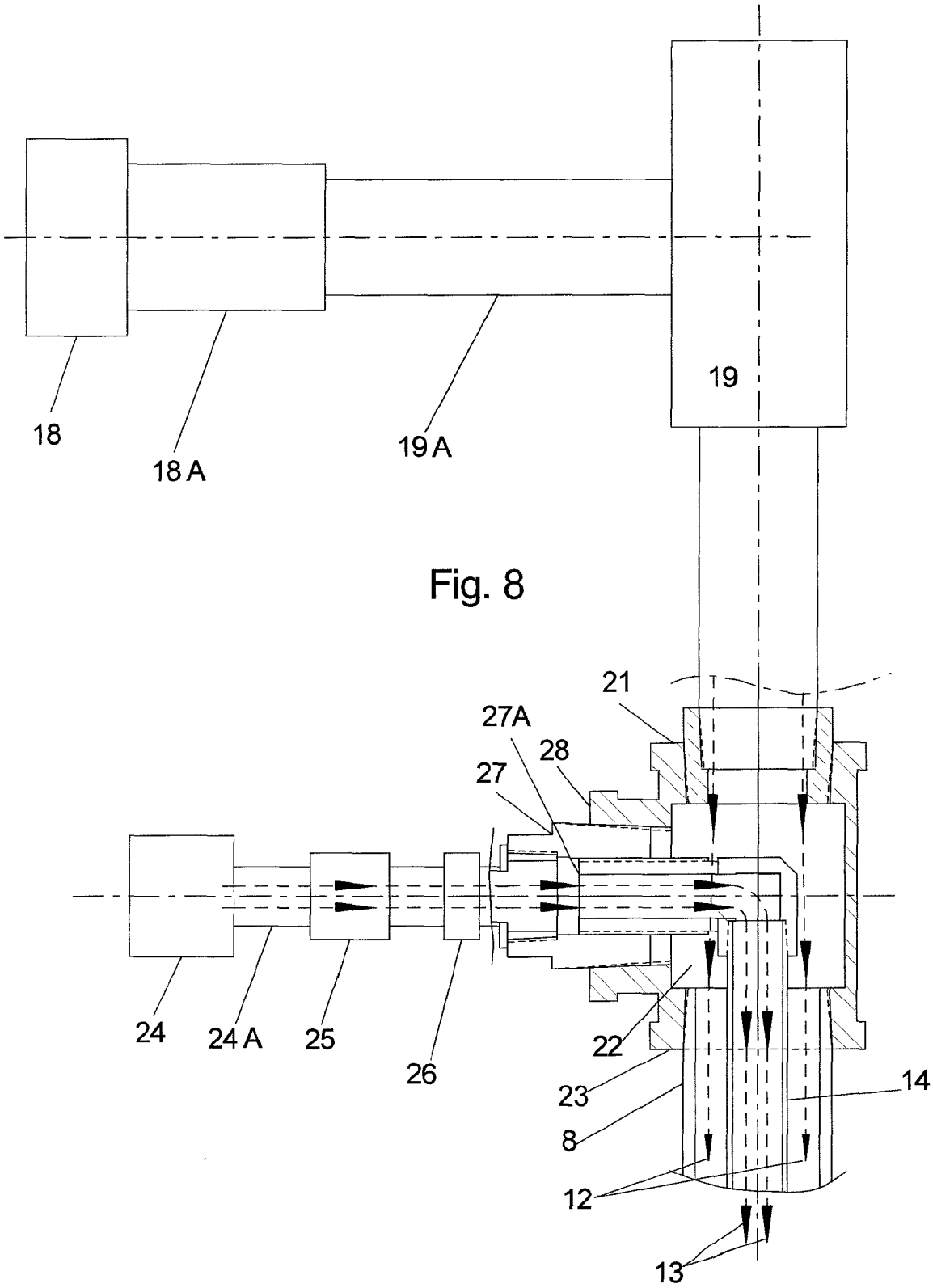
FIG. 8 is a side view illustrating a modified system of FIG. 1 which changes the location of the source of pressurized gas and the source of fluidized material.

FIG. 8 shows an embodiment (a replacement for the upper portion of FIG. 1) that does not retain the simplicity of construction of the liquid supply entry, into the complete system, but which reverse the positions of the air supply port 21 and the liquid supply port 28. This places the air supply valve 19 and the liquid supply valve 25 in the alternative positions as may be desired by certain users for particular applications. The lower portion of FIG. 8 illustrates a feasible and effective means of introducing liquid into the central liquid conducting tube 14 from the side of the plenum 22. A liquid entrance tube 27 A is threaded so as to engage the liquid conducting tube adaptor 27 at the left end, and at the other end has a threaded connection to the liquid conducting tube 14. The purpose of the threaded connection to the liquid conducting tube adaptor 27 is to permit adjustment of the liquid entrance tube 27 A at it's right end, to be approximately aligned to the centerline of the tube assembly.

Figure 9:
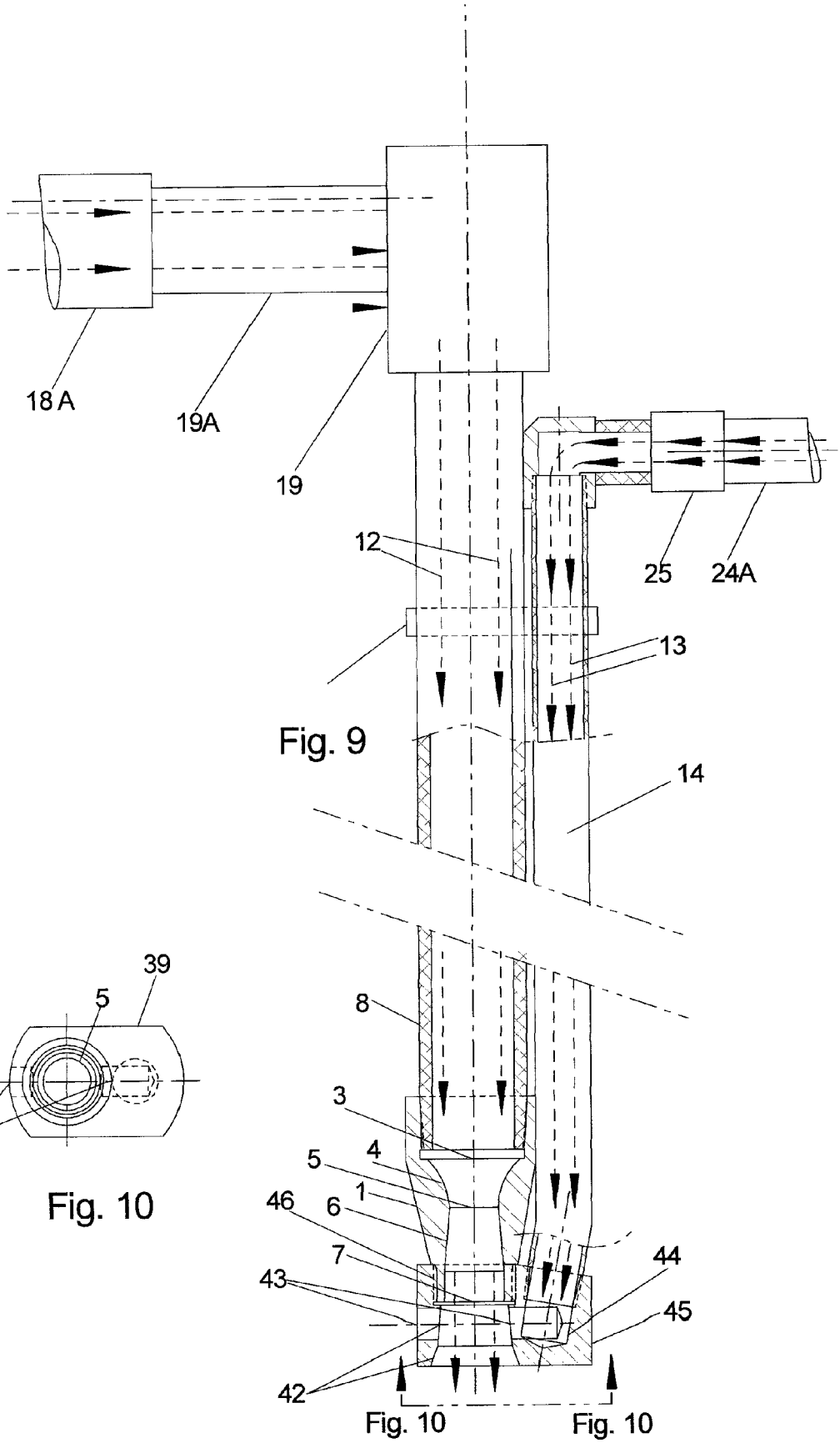
FIG. 9 is a side elevation view, partially is section, of a material bed working system according to a further embodiment of the present invention and for implementing the methods according to one aspect of the present invention.
Figure 10:
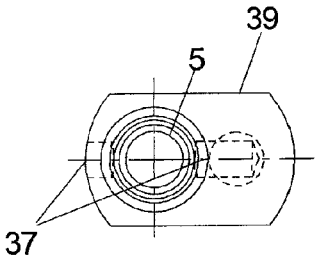
FIG. 10 is a bottom end view of the system of FIG. 9 taken along line 10-10.

FIG. 9 illustrates a further embodiment of the invention. The barrels in this embodiment are not concentric, but parallel to each other. The barrels are held together near their upper extent by a band 47. At the lower ends of the barrels, the supersonic nozzle 1 at its exit 7 is joined to the a liquid tube extension 44, both within a liquid/air connector 45. In this configuration, the liquid still enters the supersonic: jet as it exits from the supersonic nozzle 1 at supersonic speed, but the liquid enters from the side of the jet, which is less efficient, and which results in a bulkier foot print for entry into and removal from the ground 2. Also, the air/liquid expansion surface 42 is larger in area than the nozzle exit to accommodate the combined air and fluid combined exit flow. FIG. 10 is an external view of the working end of FIG. 9.

In addition to the description above, it can be noted that the primary material of construction may be effectively formed of high strength aluminum to minimize weight. Also, since the maximum air velocity is also the location of liquid introduction, the use of auxiliary pumping mechanism for supplying liquid is minimized sufficient to not require auxiliary pumping when the liquid supply conduit length is relatively short, i.e. less than about 100 feet. A secondary pump for the liquid or fluidized material may be provided, if desired.

In short the present invention provides a tool suitable for soil excavation that can be used in a number of distinct applications. This invention described above in connection with FIGS. 1-8 comprises of an integrated, axis concentric system that facilitates supersonic air digging and beneficial liquid injection into the soil or other materials In all the above described embodiments, the air and liquid flow paths, before entry into their respective barrels, are controlled by separate valves. Once they enter their respective barrels, which are concentric with each other in FIGS. 1-8, the flows combine at the optimum location for most efficient liquid injection. This optimum location is within the exit stream of the supersonic nozzle. Since the liquid exit stream is at and within the supersonic nozzle exit air stream, it is drawn into the air stream at the location of the highest air velocity available (supersonic). Also, since it is not introduced into the air stream within the nozzle interior, it does not disrupt the development of the supersonic air jet.

At the discretion of the operator, the tool can be operated as a supersonic air digger of maximum efficiency, without simultaneous liquid injection, when that option is selected. Furthermore, since the exit of the liquid path and the air path are coaxial, and the liquid entry into the air stream velocity is oriented in the same direction as the exit air velocity and physically contained within the air stream, the rate of liquid injection can be further increased by the adding a pumping source for the liquid at it's source or elsewhere along it's path towards the tool. The tool, being compact and constructed largely of light weight materials, is capable of being operated by a single person, or in substantially larger versions, mounted on mechanical platform or support.

Although the present invention has been described with particularity herein, the scope of the present invention is not limited to the specific embodiments disclosed. It will be apparent to those of ordinary skill in the art that various modifications may be made to the present invention without departing from the spirit and scope thereof. The scope of the invention is not to be limited by the illustrative examples described above. The scope of the present invention is defined by the appended claims and equivalents thereto.

What is claimed is:

1. A method of soil working performing one or more of soil fracture, soil excavation and soil treatment, said method comprising the steps of:

Supplying a source of pressurized gas;

Supplying a source of fluidized material;

Positioning a tool, which is coupled to the source of pressurized gas and to the source of fluidized material and includes a distal end having a distal exit opening and a nozzle with a contraction portion and a throat, with the distal end thereof adjacent the soil;

Directing a stream of the pressurized gas from the source of pressurized gas through the nozzle and through the distal exit opening of the tool at the soil being worked; and Entraining a stream of fluidized material from the source of fluidized material in the gas stream within the tool after the gas stream passes the throat of the nozzle and prior to the combined gas and fluidized material stream exiting the distal exit opening.

2. The method of soil working of claim 1 wherein the gas directed at the soil and entraining the fluidized material is air.

3. The method of soil working of claim 2, wherein the stream of fluidized material is comprised of solid particles.

4. The method of soil working of claim 2, wherein the stream of fluidized material is comprised of liquid.

5. The method of soil working of claim 2, wherein the stream of fluidized material is entrained in the stream of air at a position downstream of a diverging portion of the nozzle and of an exit of the nozzle at the end of the diverging portion of the nozzle.

6. The method of soil working of claim 5 further comprising the step of providing co-axial barrels conveying the air stream and the stream of fluidized material to the nozzle and the entrainment position, respectively.

7. The method of soil working of claim 6 wherein the barrel conveying the stream of fluidized material to the entrainment position is radial inwardly of the barrel conveying the stream of air to the nozzle.

8. The method of soil working of claim 7 further including the step of providing radial locating pins to position the barrel conveying the stream of fluidized material to the entrainment position is radial inwardly of the barrel conveying the stream of air to the nozzle.

9. The method of soil working of claim 6 further including the step of providing a user protecting shield around the outer barrel.

10. The method of soil working of claim 2 further including controls selectively controlling the flow of the air stream and the stream of fluidized material, respectively, and wherein the distal end and distal exit opening is formed in a removable tip.

11. A method of working a material bed for performing one or more of fracture of the bed material, excavation of the bed material and treatment of the bed material, said method comprising the steps of:

Supplying a source of pressurized gas;

Supplying a source of fluidized material;

Providing hand held tool having co-axial barrels, one barrel conveying the gas from the source of pressurized gas forming a gas stream and the other barrel conveying fluidized material from the source of fluidized material forming a fluidized material stream, wherein the tool has a distal end having a distal exit opening and a nozzle with a contraction portion and a throat;

Entraining the stream of fluidized material in the gas stream to form a combined stream at a position in the tool between the throat and the distal exit opening of the tool; and Impacting the combined streams against the material bed being worked.

12. The method of working a material bed of claim 11 wherein the material bed is soil and the gas directed at the soil and entraining the fluidized material is air.

13. The method of soil working of claim 12 wherein the barrel conveying the stream of fluidized material to the entrainment position is radial inwardly of the barrel conveying the stream of air.

14. The method of soil working of claim 12 further including the step of providing radial locating pins to position the barrel conveying the stream of fluidized material to the entrainment position is radial inwardly of the barrel conveying the stream of air.

15. The method of soil working of claim 12 further including the step of providing a user protecting shield around the outer barrel.

16. The method of soil working of claim 12 further including controls selectively controlling the flow of the air stream and the stream of fluidized material, respectively.

17. The method of soil working of claim 12 further including a pump for pressurizing the stream of fluidized material and wherein the distal end and distal exit opening is formed in a removable tip.

18. An apparatus for working a material bed for performing one or more of fracture of the bed material, excavation of the bed material and treatment of the bed material, said apparatus comprising a hand held tool having co-axial barrels, one barrel configured to be coupled to a source of pressurized gas for conveying the gas from the source of pressurized gas to form a gas stream and the other barrel configured to be coupled to a source of fluidized material for conveying fluidized material from the source of fluidized material to form a stream of fluidized material, wherein the tool has a distal end having a distal exit opening and a nozzle with a contraction portion and a throat, and wherein the tool is configured for entraining the stream of fluidized material in the gas stream to form a combined stream at a position in the tool between the throat and the distal exit opening of the tool, and wherein the tool is configured for impacting the combined stream against the material bed being worked.

19. The apparatus of claim 18 wherein the barrel conveying the stream of fluidized material to the entrainment position is radial inwardly of the barrel conveying the stream of gas.

20. The apparatus of claim 18 further including a user protecting shield around the outer barrel.

* * * * *